US012203237B2

(12) United States Patent
Dollar

(10) Patent No.: US 12,203,237 B2
(45) **Date of Patent: *Jan. 21, 2025**

(54) MALLEABLE EXCAVATION ATTACHMENT DEVICE

(71) Applicant: David Dollar, Winter Garden, FL (US)

(72) Inventor: David Dollar, Winter Garden, FL (US)

( * ) Notice: Subject to any disclaimer, the term of this patent is extended or adjusted under 35 U.S.C. 154(b) by 877 days.

This patent is subject to a terminal disclaimer.

(21) Appl. No.: 17/362,505

(22) Filed: Jun. 29, 2021

(65) Prior Publication Data

US 2021/0324601 A1 Oct. 21, 2021

Related U.S. Application Data

(63) Continuation-in-part of application No. 17/140,563, filed on Jan. 4, 2021, now Pat. No. 11,078,643.

(60) Provisional application No. 63/000,144, filed on Mar. 26, 2020.

(51) Int. Cl.
*E02F 3/40* (2006.01)

(52) U.S. Cl.
CPC ..... *E02F 3/401* (2013.01)

(58) Field of Classification Search
CPC . E02F 3/40; E02F 3/401; E02F 3/8152; E02F 3/60; E02F 37/446
See application file for complete search history.

(56) References Cited

U.S. PATENT DOCUMENTS 1,803,654 A * 5/1931 Ronk ..... E02F 9/2808 37/444
2,962,821 A * 12/1960 Peitl ..... E01H 5/062 37/446
3,281,972 A * 11/1966 Kerestes ..... E02F 9/2808 172/698
3,465,456 A * 9/1969 Meyer ..... E01H 1/105 172/701.3
3,478,449 A * 11/1969 Baker ..... E02F 3/962 172/749
3,497,973 A * 3/1970 Campbell ..... E02F 9/2816 172/701.3
3,520,076 A * 7/1970 Nichols ..... E02F 9/2841 172/701.3
4,550,512 A * 11/1985 Felstet ..... E02F 9/2808 172/753
4,729,180 A * 3/1988 Hendricks ..... E02F 9/2808 37/903

(Continued)

*Primary Examiner* — Jamie L McGowan
(74) *Attorney, Agent, or Firm* — Jason T. Daniel, Esq.; Daniel Law Offices, P.A.

(57) ABSTRACT

An excavation attachment device includes a pair of elongated malleable members that are positioned between a rigid top plate and a rigid bottom plate. Each of the malleable members being constructed from rubber and include a forward edge that extends outward beyond the forward edges of the top and bottom plates. A gap is provided between the malleable members for receiving the forks of an excavator bucket. A mounting bracket is positioned along the back edge of the top plate and includes a first set of openings for receiving connectors to selectively engage the bottom wall of an excavator bucket. The mounting bracket also including a pair of protrusions along each end having a second set of openings for receiving connectors to selectively engage the side walls of the excavator bucket.

17 Claims, 7 Drawing Sheets

(56) References Cited

U.S. PATENT DOCUMENTS 4,905,386 A * 3/1990 Taylor ..... E02F 9/245 37/446
5,253,449 A * 10/1993 Webb ..... E02F 3/962 37/444
5,377,766 A * 1/1995 Klinger ..... E02F 3/962 172/382
5,743,032 A * 4/1998 Vauhkonen ..... E01H 5/062 172/701.3
6,098,321 A * 8/2000 Logan ..... E02F 3/962 37/409
6,230,424 B1 * 5/2001 Renski ..... E02F 3/8152 37/444
6,434,865 B2 * 8/2002 Renski ..... E02F 3/8152 37/449
6,662,478 B1 * 12/2003 Virnig ..... E02F 3/8152 37/444
6,751,894 B2 * 6/2004 Verseef ..... E01H 5/062 37/232
6,810,610 B2 * 11/2004 Hardman ..... E02F 9/2858 37/450
6,922,924 B2 * 8/2005 Jones ..... E02F 3/8152 37/457
7,131,221 B2 * 11/2006 Schmeichel ..... E01H 5/061 37/231
7,673,403 B2 * 3/2010 Bridges ..... E02F 3/962 37/446
D623,671 S * 9/2010 Bolyard ..... D15/32
7,797,861 B2 * 9/2010 Wright ..... E02F 3/401 37/444
8,191,287 B2 * 6/2012 Winter ..... E01H 5/061 37/266
8,464,443 B2 * 6/2013 Torgrimsen ..... E02F 3/40 37/444
8,844,173 B2 * 9/2014 Winter ..... E01H 5/061 37/266
8,984,778 B2 * 3/2015 Fox ..... E01H 5/062 37/266
9,290,898 B2 * 3/2016 Abramczyk ..... E01H 5/061
9,428,874 B2 * 8/2016 Winter ..... E01H 5/061
9,938,678 B2 * 4/2018 Lakin ..... E01H 5/061
11,078,643 B1 * 8/2021 Dollar ..... E02F 9/245
2002/0078607 A1 * 6/2002 Perry ..... E02F 9/2883 37/446
2006/0145489 A1 * 7/2006 Shapiro ..... E01H 5/061 293/38
2012/0186112 A1 * 7/2012 Tulibaski ..... E02F 3/962 37/195
2012/0260537 A1 * 10/2012 Winter ..... E01H 5/061 37/270
2015/0135561 A1 * 5/2015 Henning ..... E01H 5/066 37/448

* cited by examiner

MALLEABLE EXCAVATION ATTACHMENT DEVICE

CROSS-REFERENCE TO RELATED APPLICATIONS

This application claims the benefit of U.S. Application Ser. No. 63/000,144 filed on Mar. 26, 2020, and U.S. patent application Ser. No. 17/140,563, filed on Jan. 4, 2021, the contents of each of which are incorporated herein by reference.

TECHNICAL FIELD

The present invention relates generally to construction equipment, and more particularly to an excavation attachment device having at least one malleable surface.

BACKGROUND

The statements in this section merely provide background information related to the present disclosure and may not constitute prior art.

In the construction industry, it is common to utilize heavy equipment such as an excavator, for example, to dig holes and trenches within the ground. Prior to commencement, a utility services provider will typically provide a series of markings along the surface so as to identify the detected locations of subsurface utility components such as electrical cables, gas lines, water lines, sewer lines and/or cable television lines, for example.

Although these markings are helpful for identifying the general location of the underground utilities, it is extremely difficult to find and mark the exact location for every component. Indeed, it is not uncommon for these markings to be off by several feet, thus resulting in damage to the unmarked lines upon being struck by the metallic teeth of the excavator bucket or other such digging instrument.

Accordingly, it would be beneficial to provide a malleable attachment device for an excavator bucket and other digging equipment capable of bending when encountering an underground utility component.

SUMMARY OF THE INVENTION

The present invention is directed to an excavation attachment device. One embodiment of the present invention can include a pair of elongated malleable members that are positioned between a rigid top plate and a rigid bottom plate. Each of the malleable members can be constructed from tough malleable materials such as rubber and include a forward edge that extends outward beyond the forward edges of the top and bottom plates.

In one embodiment, a mounting bracket can be positioned along the back edge of the top plate. The mounting bracket can include a first set of openings for receiving connectors to selectively engage the bottom wall of an excavator bucket. The mounting bracket can also include a pair of protrusions along each end having a second set of openings for receiving connectors to selectively engage the side walls of the excavator bucket.

In one embodiment, each of the top plate, the malleable members and the bottom plate include a pair of openings that are aligned serially to receive a connector. The connector including functionality for providing an adjustable gap between the two malleable members for receiving the forks of the excavator bucket, and subsequently tightening the same.

In one embodiment, the malleable members comprise a single malleable member having an opening along the back side. In the present embodiment, the mounting bracket can be positioned along the bottom plate and can connect to the excavator bucket with the excavator forks located inside the opening.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
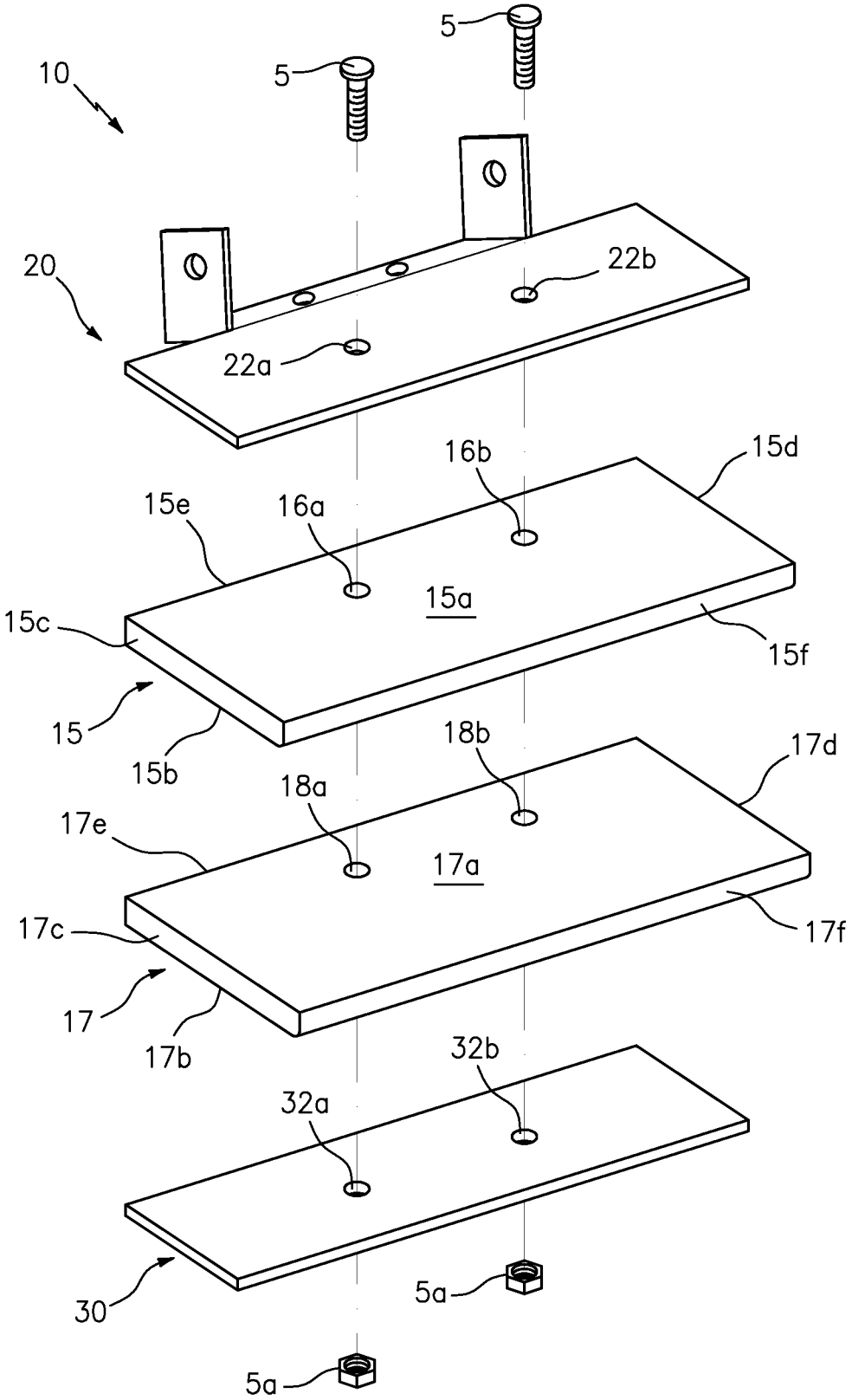
FIG. 1 is an exploded parts view of one embodiment of the malleable excavation attachment device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, the term "removably secured," and derivatives thereof shall be used to describe a situation wherein two or more objects are joined together in a non-permanent manner so as to allow the same objects to be repeatedly joined and separated.

As described herein, the term "connector" can include any number of different elements that work together to removably join two items together. Several nonlimiting examples include nuts and bolts, opposing strips of hook and loop material (i.e., Velcro®), attractively-oriented magnetic elements, flexible strips of interlocking projections with a slider (i.e., zipper), tethers, buckles such as side release buckles, and compression fittings such as T-handle rubber draw latches, hooks, snaps and buttons, for example. Each illustrated connector can be permanently secured to the illustrated portion of the device via a permanent sealer such as glue, adhesive tape, or stitching, for example.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

FIGS. 1-8 illustrate one embodiment of a malleable excavation attachment device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in FIG. 1, one embodiment of the device 10 can include a pair of elongated malleable members 15 and 17 that are positioned between a top plate 20, and a bottom plate 30.

In one embodiment, malleable member 15 can include a generally rectangular-shaped body having a top surface 15*a*, a bottom surface 15*b*, outer edges 15*c*/15*d*, a back edge 15*e*, and forward edge 15*f*. A pair of apertures 16*a* and 16*b* are provided along the member 15 and extend through the top and bottom surfaces. Likewise, malleable member 17 can also include a generally rectangular-shaped body having a top surface 17*a*, a bottom surface 17*b*, outer edges 17*c*/17*d*, a back edge 17*e*, and forward edge 17*f*. A pair of apertures 18*a* and 18*b* are provided along the member 17 and extend through the top and bottom surfaces.

In one embodiment, each of the malleable members 15 and 17 can include substantially identical shapes and sizes and can be constructed from rubber sheets having a thickness of approximately 1 inch. Of course, the inventive concepts are not limited to such shapes and construction materials, as other embodiments are contemplated wherein each of the malleable members include different shapes or sizes, and are constructed from any number of different malleable materials such as natural rubber, synthetic rubber, closed cell foam, and the like.

Moreover, other embodiments are contemplated wherein the malleable members are constructed from repurposed materials such as new or used vehicle tires, for example, that are cut into sections. Further, the inventive concepts are not limited to the use of two malleable members, as other embodiments having a single malleable member or more than two malleable members are also contemplated.

Figure 2:
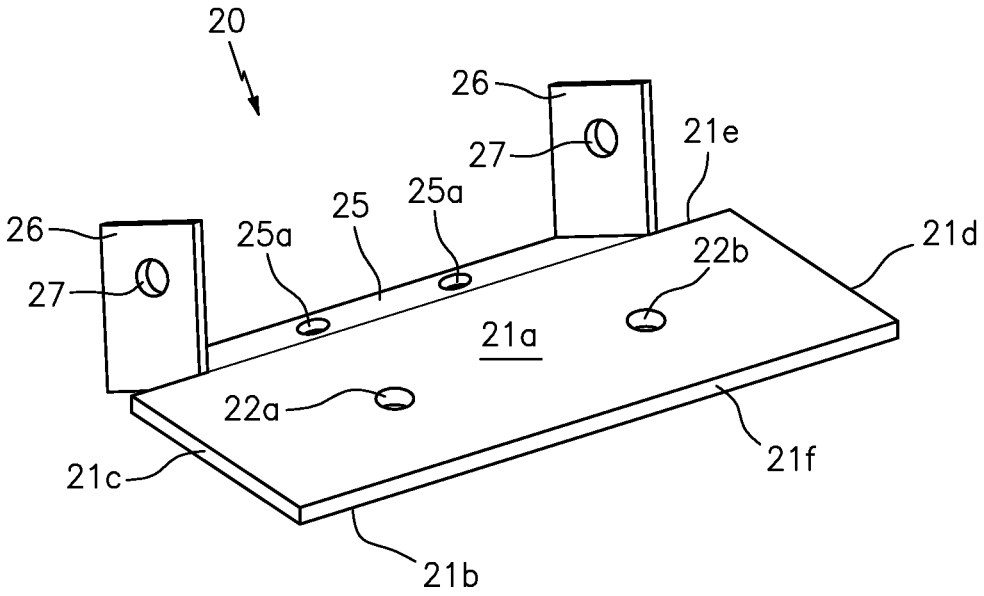
FIG. 2 is a top perspective view of the top plate of the malleable excavation attachment device, in accordance with one embodiment of the invention.

FIG. 2 illustrates one embodiment of the top plate 20. As shown the plate can include a generally rectangular shaped member having a top surface 21*a*, a bottom surface 21*b*, outer edges 21*c*/21*d*, a back edge 21*e*, and forward edge 21*f*. A pair of apertures 22*a* and 22*b* can be positioned along the top plate so as to extend through the top and bottom surfaces.

In the preferred embodiment, the top plate can be constructed from a rigid and non-malleable material such as steel, for example, and can include a depth (e.g., distance between the back edge 21*e* and forward edge 21*f*) that is less than the depth of the above noted malleable members 15 and 16, so as to ensure the malleable members extend outward from the forward edge 21*f*. Of course, any number of other shapes, sizes and/or construction materials are also contemplated.

In one embodiment, the top plate 20 can include an elongated, generally flat bracket member 25 that extends parallel to and outward from the back edge 21*e*. The flat bracket member can include openings 25*a* for receiving connectors such as nuts and bolts, for example, to secure the bracket onto the inside bottom portion of an excavator bucket, such that the forward edge 21*f* of the plate body extends outward therefrom.

In one embodiment, a pair of protrusions 26 can extend upward from each end of the flat bracket member 25. As will be described below, the bracket 25 of this embodiment can be sized to include a width (e.g., distance between the protrusions 26) that is complementary to the width of an excavator bucket for which the device 10 of this embodiment is constructed to be secured. In such an embodiment, openings 27 positioned along each of the protrusions 26 can function to receive connectors such as nuts and bolts, for example, to secure the bracket to the sides of the excavator bucket via complementary located openings on the bucket.

In the preferred embodiment, the bracket and protrusions will preferably be constructed from the same material as the top plate 20 so as to be formed as an integral component thereto. Of course, other embodiments are contemplated wherein the bracket includes a different shape, is constructed from a different material, and/or is manufactured as a separate component and is then permanently secured onto the plate. Additionally, although described as being located along the top plate 20, other embodiments are contemplated wherein the bracket is located at other locations such as the bottom plate, for example.

In various embodiments, the bracket 25 can be positioned so as to orient the main body of the top plate (e.g., top surface, forward edge) at any number of different angles θ relative to the bracket. For example, the bracket can be positioned at angles of between approximately −20 and 20 degrees, for example, so as to orient the plate body upward or downward relative to the angle of the bottom wall of the excavator bucket to which the plate is attached. Such a feature allowing the device 10 to be customized for specific digging duty and to increase the efficiency of the device when engaging the ground. Of course, any number of other angles are also contemplated.

Figure 3:
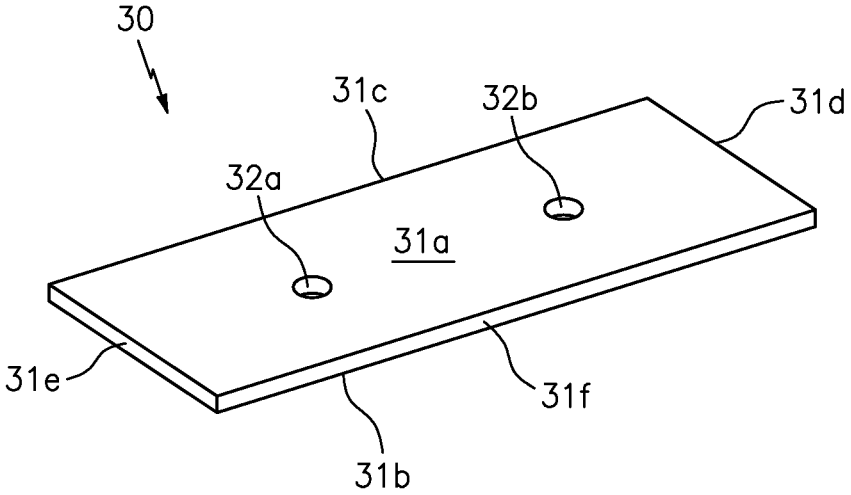
FIG. 3 is a top perspective view of the bottom plate of the malleable excavation attachment device, in accordance with one embodiment of the invention.

FIG. 3 illustrates one embodiment of the bottom plate 30. As shown the plate can include a generally rectangular shaped member having a top surface 31*a*, a bottom surface 31*b*, outer edges 31*c*/31*d*, a back edge 31*e*, and forward edge 31*f*. A pair of apertures 32*a* and 32*b* can be positioned along the bottom plate so as to extend through the top and bottom surfaces.

In the preferred embodiment, the bottom plate can be constructed from a rigid and non-malleable material such as steel, for example, and can include a depth (e.g., distance between the back edge 31*e* and forward edge 31*f*) and width (e.g., distance between side edges 31*c* and 31*d*) that are complementary to the depth and width of the top plate 20.

Figure 4:
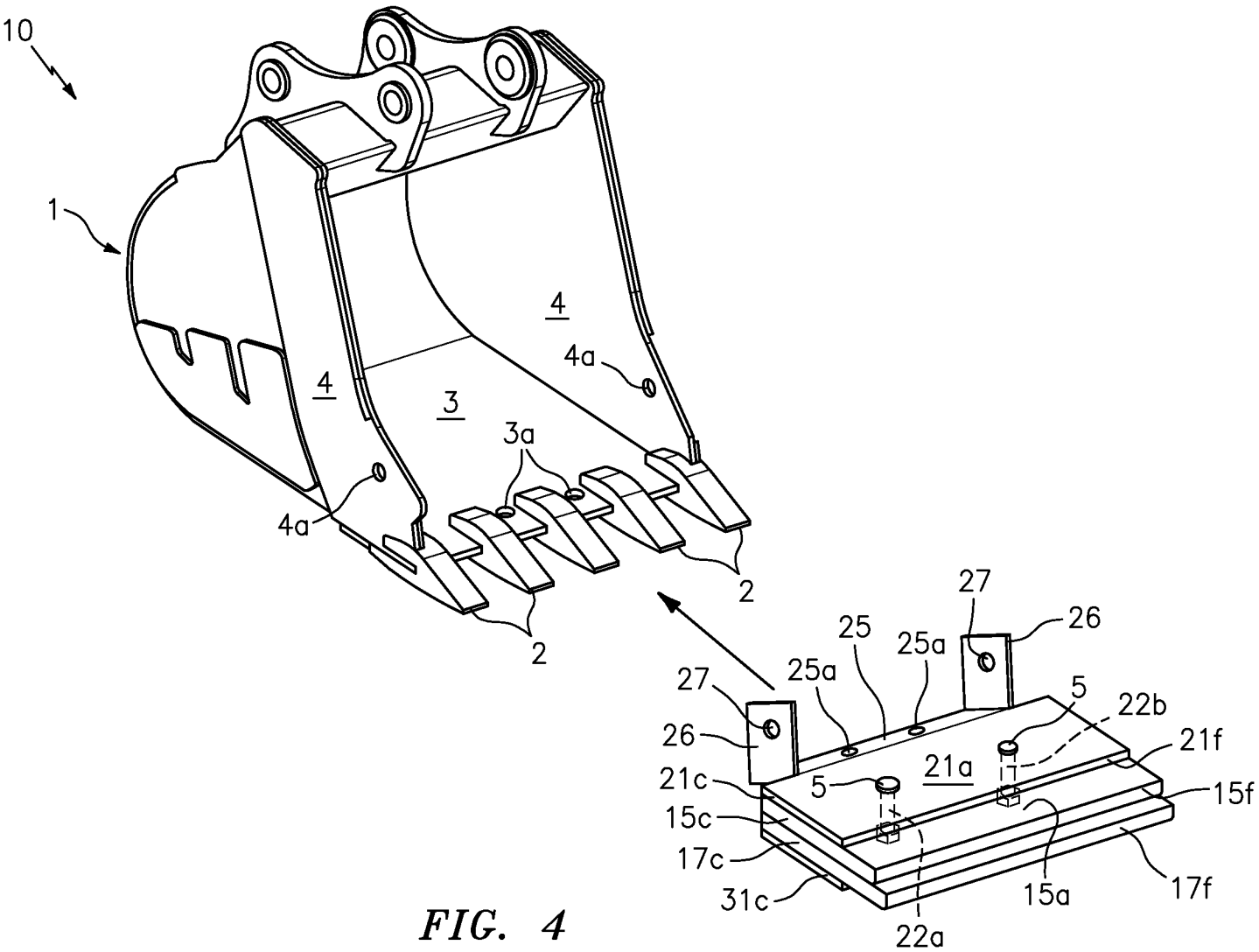
FIG. 4 is a perspective view of the malleable excavation attachment device in operation, in accordance with one embodiment of the invention.
Figure 5:
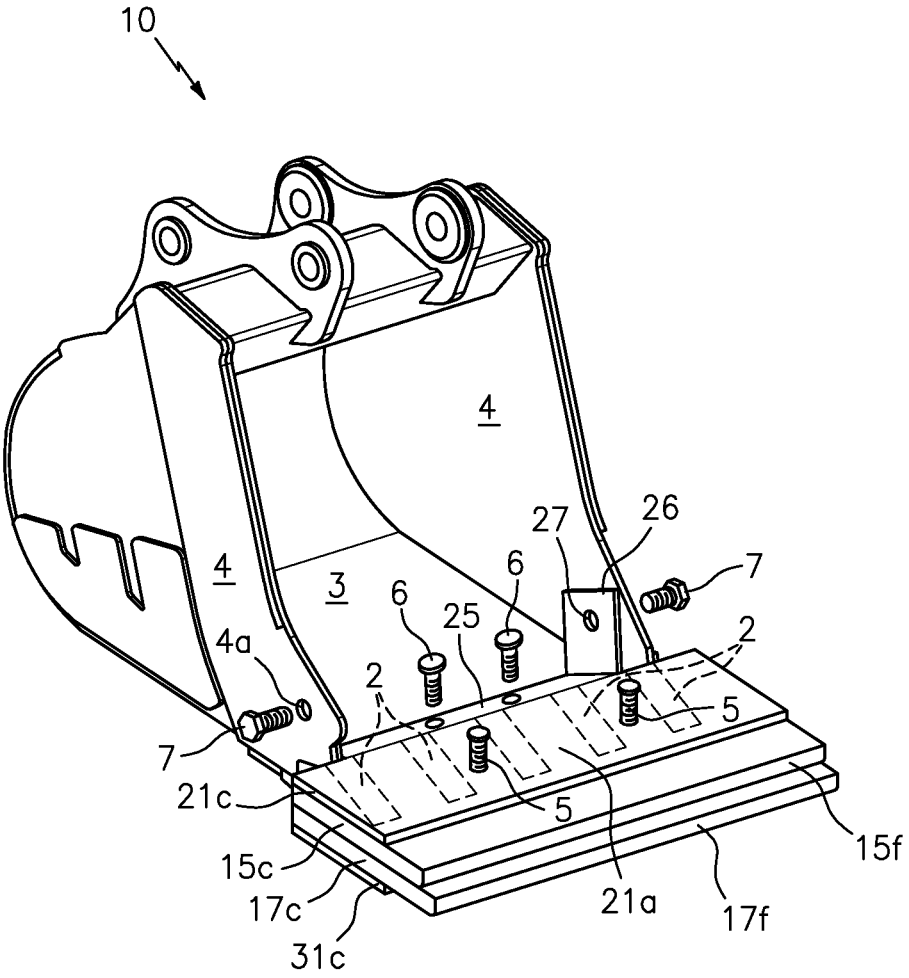
FIG. 5 is another perspective view of the malleable excavation attachment device in operation, in accordance with one embodiment of the invention.

FIGS. 4 and 5 illustrate one embodiment of the device 10 in operation. As shown, the device can be assembled by first aligning openings 22*a*, 16*a*, 17*a* and 32*a* vertically, and aligning openings 22*b*, 16*b*, 17*b* and 32*b* vertically (See also FIG. 1), and positioning connectors 5 (e.g., bolts) through the aligned openings and loosely (i.e., providing the minimum necessary attachment of the nut and bolt to prevent complete separation of the device components) securing the same with complementary connectors 5*a* (e.g., nuts), for example.

When so positioned, there will be an adjustable gap between the two malleable members 15 and 17. As such, the user can position the forks 2 of the excavator bucket 1 between the malleable members and slide the device 10 toward the bucket until the back of the device 10 is positioned against the bottom-front side of the excavator bucket. At this time, the bottom of the flat bracket section 25 will be located against the top surface of the bottom wall 3 of the bucket and can be secured thereto via a second set of connectors 6 that are positionable through the openings 25*a* and complementary located openings 3*a* on the bucket bottom.

If the device 10 is manufactured for use with the specific bucket 1, the protrusions 26 of the mounting bracket will be positioned against the sides 4 of the bucket, and a third set of connectors 7 can be positioned through the openings 27 and complementary positioned openings 4*a* of the bucket sides to secure the device to the excavator bucket. The use of openings 27 and connectors 7 can be in addition to, or instead of using openings 25*a* and connectors 6 described above.

In either instance, once the top plate is connected to the bucket, all of the connectors (e.g., 5, 6 and/or 7) can be tightened to firmly secure the device onto the excavator bucket. As shown, when the device is positioned onto the excavator bucket, the front ends of the malleable members 15*f* and 17*f* extend beyond the front of the metallic forks 2, and are the first things to touch and engage the ground. Because the members 15 and 17 are malleable, they are able to soften impacts with underground utilities, thus reducing or eliminating damage to the same.

Figure 6:
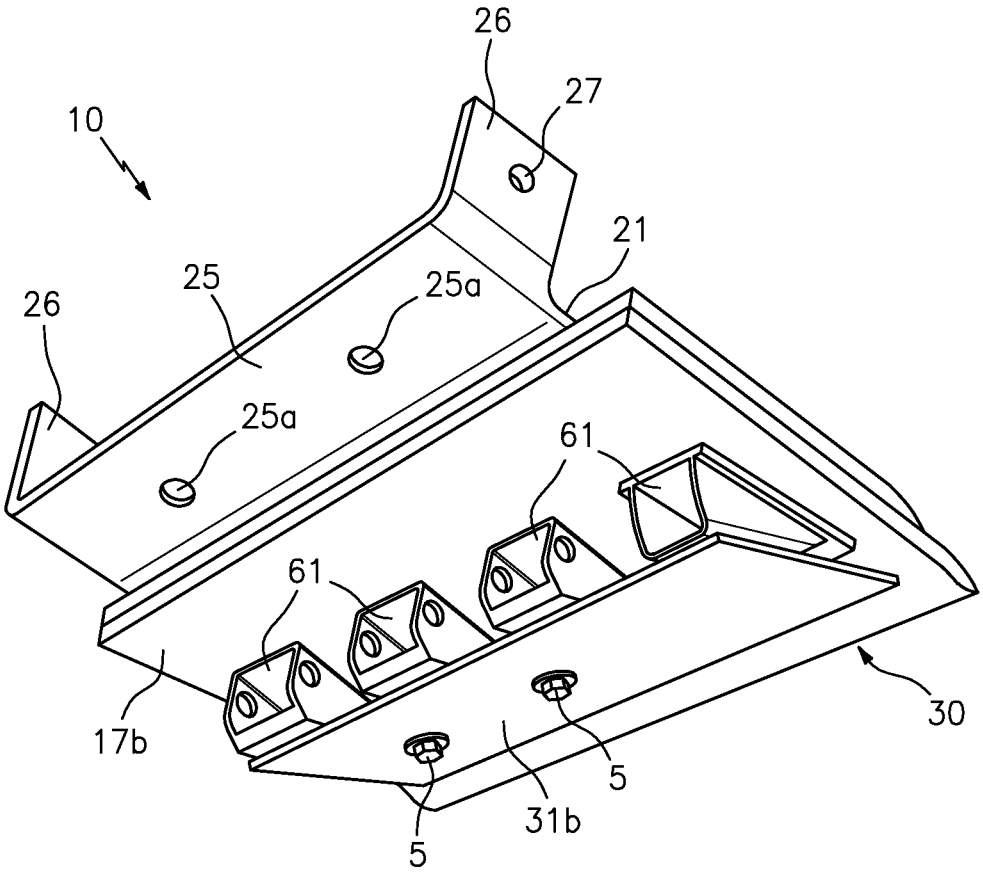
FIG. 6 is a bottom perspective view of the malleable excavation attachment device, in accordance with one embodiment of the invention.

Although described above as positioning the excavator forks 2 between two malleable members prior to tightening the connectors, other embodiments are contemplated. To this end, FIG. 6 illustrates one embodiment of the malleable excavation attachment device 10 that includes a plurality of fork sleeves 61 that are positioned along the top surface of the bottom panel 30.

As shown, each of the sleeves 61 can include a generally hollow member having an opening one end for receiving an individual excavator fork. In one embodiment, the fork sleeves can be constructed from metal, and can include a shape, a size, and a separation distance that is complementary to the shape, size and separation distance of the forks of the known excavator bucket, so as to be able to individually receive the same.

Such a feature greatly simplifying installation of the device whereby the forks can engage the sleeves, and the device can be secured to the bottom or sides of the bucket without requiring a user to physically lift the device, manually position the forks between the malleable members, and slide the device backward before securing via connectors 6 and/or 7.

In another embodiment, the fork sleeves 61 can be positioned between the malleable members 15 and 17, and can be secured thereto by the connectors 5, as noted above.

Figure 7:
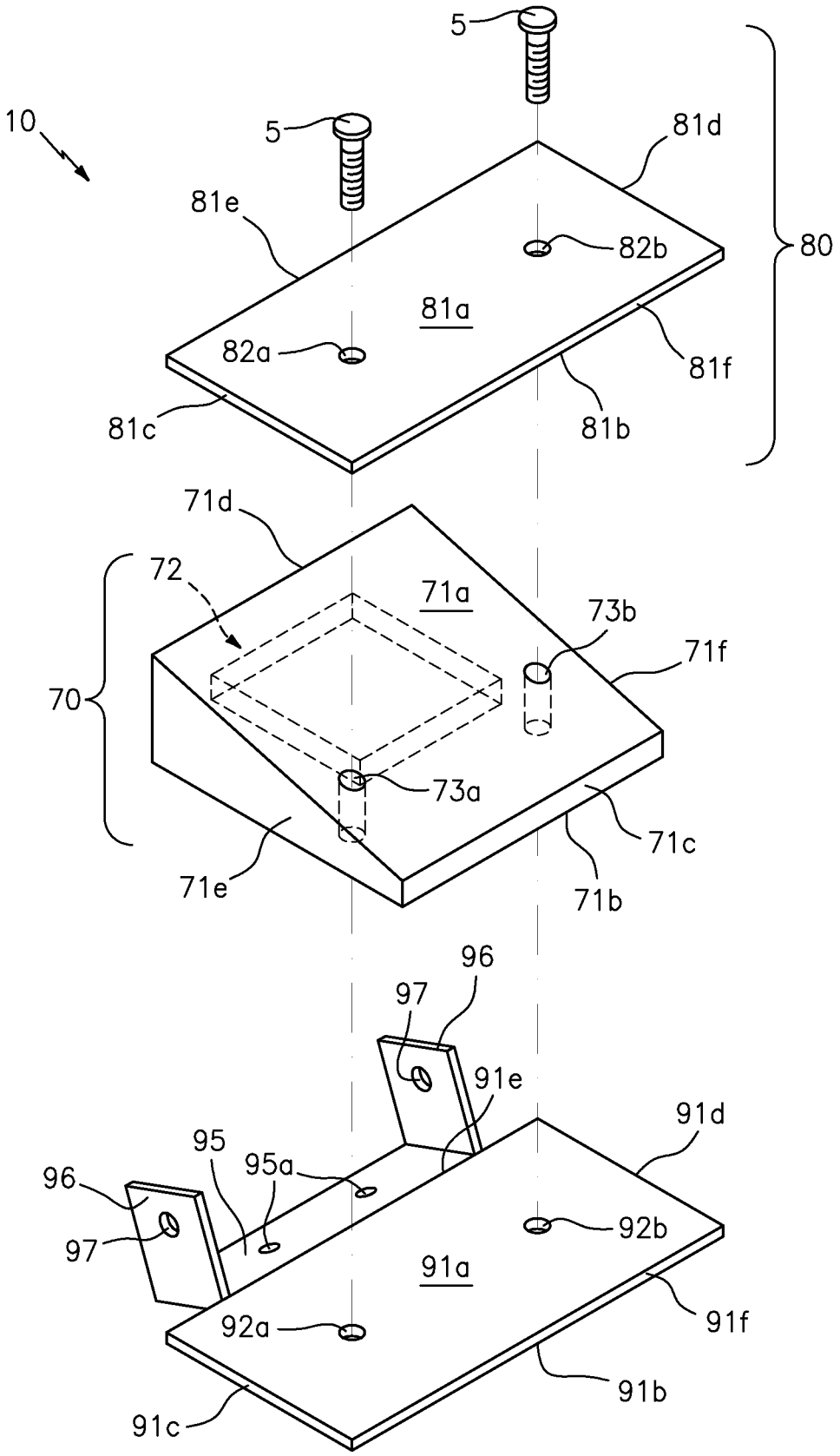
FIG. 7 is another exploded parts view of the malleable excavation attachment device, in accordance with one embodiment of the invention.

FIG. 7 illustrates another embodiment of the system 10 that includes a single malleable member 70 that is positioned between a top plate 80 and a bottom plate 90. As shown, the single malleable member 70 can include a main body having a top surface 71*a*, a bottom surface 71*b*, a front edge 71*c*, a back end 71*d*, and a pair of sides 71*e* and 71*f*. An elongated opening 72 can be positioned along the back end 71*d*, and can extend toward the front edge 71*c*, and a pair of apertures 73*a* and 73*b* can extend from the top surface to the bottom surface. Malleable member 71 can be constructed from the same materials described above with regard to members 15 and 17, and can include a tapered shape wherein the front edge 71*c* includes a height (e.g., distance between top and bottom surfaces 71*a*-71*b*) that is less than the height of the back end 71*d*. Such a feature advantageously allowing the front edge to dig within the ground as noted above.

The top plate 80 can include a generally rectangular shaped member having a top surface 81*a*, a bottom surface 81*b*, outer edges 81*c*/81*d*, a back edge 81*e*, and forward edge 81*f*. A pair of apertures 82*a* and 82*b* can be positioned along the top plate so as to extend through the top and bottom surfaces. The top plate can be constructed from the same materials described above with regard to the top plate 20, and can also include depth that is less than the depth of the malleable member 71. Of course, many other shapes, sizes and construction materials are also contemplated.

The bottom plate 90 can include a generally rectangular shaped member having a top surface 91*a*, a bottom surface 91*b*, outer edges 91*c*/91*d*, a back edge 91*e*, and forward edge 91*f*. A pair of apertures 92*a* and 92*b* can be positioned along the bottom plate so as to extend through the top and bottom surfaces. The bottom plate 90 can be constructed from the same materials described above with regard to the bottom plate 30. Of course, any number of other shapes, sizes and/or construction materials are also contemplated.

In one embodiment, the bottom plate 90 can include an elongated, generally flat bracket member 95 that extends parallel to and outward from the back edge 91*e*. The flat bracket member can include openings 95*a* for receiving connectors such as nuts and bolts, for example, to secure the bracket onto the outside bottom portion of an excavator bucket, such that the forward edge 91*f* of the plate body extends outward therefrom.

In one embodiment, a pair of protrusions 96 can extend upward from each end of the flat bracket member 95. As will be described below, the bracket 95 of this embodiment can be sized to include a width (e.g., distance between the protrusions 96) that is complementary to the outside edge width of an excavator bucket for which the device 10 of this embodiment is constructed to be secured. In such an embodiment, openings 97 positioned along each of the protrusions 96 can function to receive connectors such as nuts and bolts, for example, to secure the bracket to the outer sides of the excavator bucket via complementary located openings on the bucket.

In the preferred embodiment, the bracket and protrusions will preferably be constructed from the same material as the bottom plate 90 so as to be formed as an integral component thereto. Of course, other embodiments are contemplated wherein the bracket includes a different shape, is constructed from a different material, and/or is manufactured as a separate component and is then permanently secured onto the plate. Additionally, although described as being located along the bottom plate 90, other embodiments are contemplated wherein the bracket is located at other locations such as the top plate, for example.

In various embodiments, the bracket 95 can be positioned so as to orient the main body of the top plate (e.g., top surface, forward edge) at any number of different angles θ relative to the bracket. For example, the bracket can be positioned at angles of between approximately −20 and 20 degrees, for example, so as to orient the plate body upward or downward relative to the angle of the bottom wall of the excavator bucket to which the plate is attached. Such a feature allowing the device 10 to be customized for specific digging duty and to increase the efficiency of the device when engaging the ground. Of course, any number of other angles are also contemplated.

Figure 8:
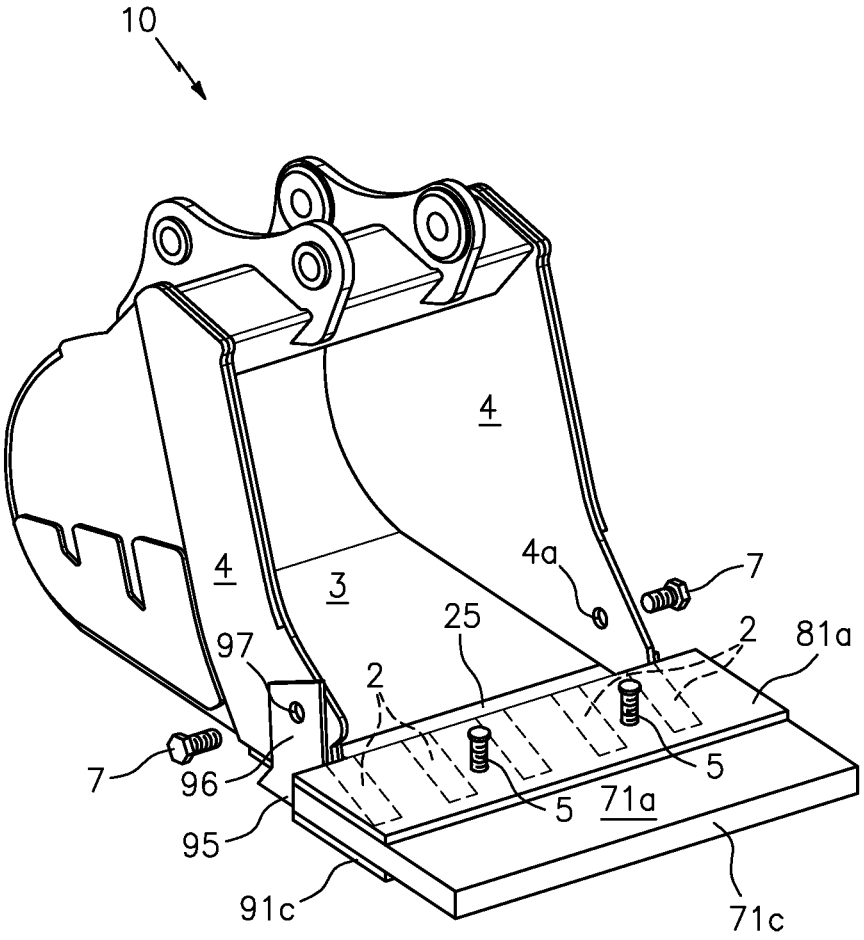
FIG. 8 is another perspective view of the malleable excavation attachment device in operation, in accordance with one embodiment of the invention.

FIG. 8 illustrates one embodiment of the device 10 in operation. As shown, the device can be assembled in much the same manner described above, whereby openings are aligned and connectors 5 are positioned vertically therethrough. Next, the user can position the forks 2 of the excavator bucket 1 into the opening 72 until the back of the device 10 is positioned against the bottom-front side of the excavator bucket. At this time, the top of the flat bracket section 95 will be located against the bottom surface of the bottom wall 3 of the bucket and can be secured thereto via a second set of connectors 6 that are positionable through the openings 95*a* and complementary located openings 3*a* on the bucket bottom.

If the device 10 is manufactured for use with the specific bucket 1, the protrusions 96 of the mounting bracket will be positioned against the outer sides 4 of the bucket, and the third set of connectors 7 can be positioned through the openings 97 and complementary positioned openings 4*a* of the bucket sides to secure the device to the excavator bucket. The use of openings 97 and connectors 7 can be in addition to, or instead of using openings 95*a* and connectors 6 described above.

Although described above with regard to a single elongated opening 72, other embodiments are contemplated wherein the single opening comprises a series of individual openings with the malleable member 70 that are spaced and sized to receive the individual forks of the excavator bucket. Alternatively, or in addition thereto, a series of metallic sleeves can be positioned within the single opening or series of individual openings to receive the individual forks of the excavator bucket.

Although described above as utilizing physical connectors to penetrate each of the top plate, the malleable members and the bottom plate, this is for illustrative purposes only. To this end, each of these components may be coupled together using any number of different types of connectors which may be located at locations other than illustrated.

As described herein, one or more elements of the malleable excavation attachment device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An excavation attachment device, comprising:

a top plate having a forward edge, a back edge, a bottom surface;

a malleable member having a top surface, a bottom surface, a forward edge, a back end;

an opening that is positioned along the back end of the malleable member;

a plurality of excavator fork sleeves that are positioned within the opening; and a bottom plate having a forward edge, a back edge, and a top surface, wherein the malleable member is positioned between the bottom surface of the top plate and the top surface of the bottom plate, and the forward edge of the at least one malleable member extends outward beyond the forward edge of the bottom plate and the forward edge of the top plate.

2. The device of claim 1, further comprising:

a mounting bracket that is positioned along one of the top plate or the bottom plate, said mounting bracket including functionality for engaging an excavator bucket.

3. The device of claim 2, wherein the opening includes a shape and a size that is configured to receive a plurality of forks located on the excavator bucket.

4. The device of claim 2, wherein the mounting bracket includes an elongated flat body section that extends outward from the back edge of the bottom plate.

5. The device of claim 4, further comprising:

a pair of openings that are positioned along the mounting bracket, said openings being configured to receive a pair of connectors for physically coupling the mounting bracket to a bottom wall of the excavator bucket.

6. The device of claim 4, wherein the elongated flat body section includes a length that is complementary to a width of the excavator bucket.

7. The device of claim 6, further comprising:

a pair of protrusions that are located along each end of the elongated flat body section, said pair of protrusions being configured to engage a first side wall and a second side wall of the excavator bucket.

8. The device of claim 7, further comprising:

a pair of openings that are positioned through the pair of protrusions, said openings being configured to receive a pair of connectors for physically coupling the protrusions of the mounting bracket to the first side wall and the second side wall of the excavator bucket.

9. The device of claim 1, wherein the malleable member is constructed from rubber.

10. An excavation attachment device, comprising:

a top plate having a forward edge, a back edge, a bottom surface;

a mounting bracket that is positioned along one of the top plate or the bottom plate, said mounting bracket including functionality for engaging an excavator bucket;

a malleable member having a top surface, a bottom surface, a forward edge, a back end;

an opening that is positioned along the back end of the malleable member, said opening including a shape and a size that is configured to receive a plurality of forks located on the excavator bucket; and a bottom plate having a forward edge, a back edge, and a top surface, wherein the malleable member is positioned between the bottom surface of the top plate and the top surface of the bottom plate, and the forward edge of the at least one malleable member extends outward beyond the forward edge of the bottom plate and the forward edge of the top plate.

11. The device of claim 10, wherein the mounting bracket includes an elongated flat body section that extends outward from the back edge of the bottom plate.

12. The device of claim 11, further comprising:

a pair of openings that are positioned along the mounting bracket, said openings being configured to receive a pair of connectors for physically coupling the mounting bracket to a bottom wall of the excavator bucket.

13. The device of claim 11, wherein the elongated flat body section includes a length that is complementary to a width of the excavator bucket.

14. The device of claim 13, further comprising:

a pair of protrusions that are located along each end of the elongated flat body section, said pair of protrusions being configured to engage a first side wall and a second side wall of the excavator bucket.

15. The device of claim 14, further comprising:

a pair of openings that are positioned through the pair of protrusions, said openings being configured to receive a pair of connectors for physically coupling the protrusions of the mounting bracket to the first side wall and the second side wall of the excavator bucket.

16. The device of claim 10, further comprising:

a plurality of excavator fork sleeves that are positioned within the opening.

17. The device of claim 10, wherein the malleable member is constructed from rubber.

* * * * *